United States Patent [19]

Wardell, Jr.

[11] Patent Number: 4,674,821

[45] Date of Patent: Jun. 23, 1987

[54] ELECTRON TUBE BASE

[75] Inventor: Myron H. Wardell, Jr., Lititz, Pa.

[73] Assignee: RCA Corporation, Princeton, N.J.

[21] Appl. No.: 834,352

[22] Filed: Feb. 28, 1986

[51] Int. Cl.[4] ..... H01R 33/76

[52] U.S. Cl. ..... 439/618; 439/150

[58] Field of Search ..... 339/144 R, 144 T, 145 T, 339/145 R, 192 T, 111, 14 T, 66 T, 193 VS, 252 T, 210 T, 176 L, 177 L, 191 L, 278 L

[56] References Cited

U.S. PATENT DOCUMENTS

| | | | |
|---|---|---|---|
| 3,388,210 | 6/1968 | Babb | 339/66 T |
| 3,979,157 | 9/1976 | DiMattio | 339/145 |
| 4,040,708 | 8/1977 | Neuber et al. | 339/111 |
| 4,345,812 | 8/1982 | Warell | 339/144 R |
| 4,426,602 | 1/1984 | Mollet et al. | 315/58 |

FOREIGN PATENT DOCUMENTS

| | | | |
|---|---|---|---|
| 3217254 | 12/1982 | Fed. Rep. of Germany | 339/144 T |
| 1066748 | 11/1951 | France | 339/144 T |

*Primary Examiner*—Gil Weidenfeld
*Assistant Examiner*—Thomas M. Kline
*Attorney, Agent, or Firm*—E. M. Whitacre; D. H. Irlbeck; L. L. Hallacher

[57] ABSTRACT

A base for a CRT has an outside diameter which is less than the outside diameter of the tube neck. A plurality of resilient detents are integral with the base and act against the exhaust tubulation to help retain the base on the neck of the tube. A silo is integral with the base and surrounds the high voltage pin. The pins freely pass through pinslots to avoid bending the pins when putting the base onto the neck. The pinslots are configured to facilitate the reception of bent or misaligned pins.

6 Claims, 3 Drawing Figures

ELECTRON TUBE BASE

BACKGROUND

This invention relates generally to electron tube bases and particularly to a cathode ray tube (CRT) base which protects the electrical pins, which extend from the tube, from bending during application of the base to the neck of the tube and while the tube is being processed.

CRTs include a neck portion in which the electron beam producing guns are mounted. A coaxial exhaust tubulation extends from a stem that closes the end of the neck. The tubulation is used to evacuate gases from the finished tube. After evacuation, the tubulation is cut off and sealed leaving a tubulation terminus and stem permanently affixed to the neck. The stem, thus, appears as an annular end wall extending between the tubulation terminus and the outer circumference of the neck. A plurality of electrical connector pins extend through the stem and are used to apply the various operating voltages to the electron gun. A hollow, cylindrical, insulative base has a pattern of pinholes in one end. The pinholes receive the connector pins when the base is coaxially applied to the end of the neck portion and about the terminus of the tubulation. Either the outer configuration of the base, or the connector pin pattern is nonsymmetrical. A socket member has a congruent and mating configuration, or pinhole pattern, so that the socket can be coupled to the base in only a particular orientation. The socket includes electrical contacts which engage the connector pins extending through the stem of the neck portion. Because the base and socket can be coupled in only one orientation, each of the electrical contacts within the socket engages a specific connector pin and the proper operating voltages are applied to the various electrodes of the electron gun.

Typically, the tubes must go through many production steps after the electron guns and electrical connector pins are mounted in the neck. However, with prior art bases the exhaust tubulation makes it impossible, or difficult, to apply the base to the tube. For this reason, the pins are unprotected and a substantial number of the pins become bent during the many processing steps. Another problem arises from the fact that when the bases are initially applied to the necks they can not be permanently applied. For this reason, it is necessary to provide a means for temporarily retaining the bases on the necks to permit the occasional removal and reapplication of the bases. A common method of temporarily retaining the bases on the necks is to dimension the connector pins and the pinholes to have an interference fit. Difficulties arise from this technique because the bases are difficult to apply to the necks and bent connector pins frequently result.

For these reasons, there is a need for a base which is easily applied to the neck of the tube and which temporarily retains the base on the neck, and also for a base which can be put onto the pins prior to many of the processing steps, to protect the pins from bending during processing. The present invention fulfills these needs.

SUMMARY

A base for a vacuum tube has a plurality of electrical connector pins arranged in a circle and extending through a stem which closes the end of a neck portion of the tube. The pins are within a circumferential drip on the neck portion and are around the terminus of an exhaust tubulation which extends from the stem. The base includes a cylindrical portion having a substantially centered bore, the diameter of which is greater than the diameter of the tubulation. A plurality of resilient detents is affixed to the cylindrical portion, and extend into the bore of the base. The detents are dimensioned to engage the tubulation to apply a biasing force to the tubulation and temporarily hold the base on the neck. A plurality of pinslots is arranged about the outside periphery of the cylindrical portion and each of the pinslots receives one of the connector pins. The pinslots have an angular inside surface extending toward the bore. The pinslots and the pins are dimensioned so that the pinslots freely receive the pins.

DETAILED DESCRIPTION

Figure 2:
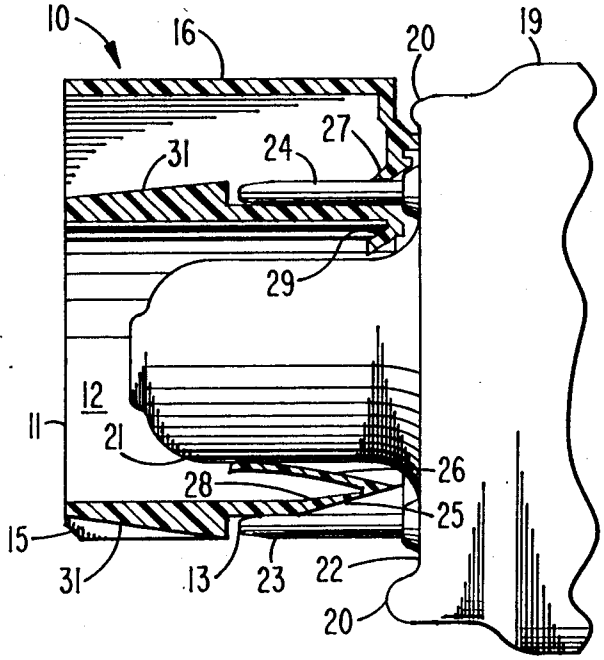
FIG. 2 is a cross section taken along line 2—2 of FIG. 1, when the base is mounted on a tube neck.
Figure 1:
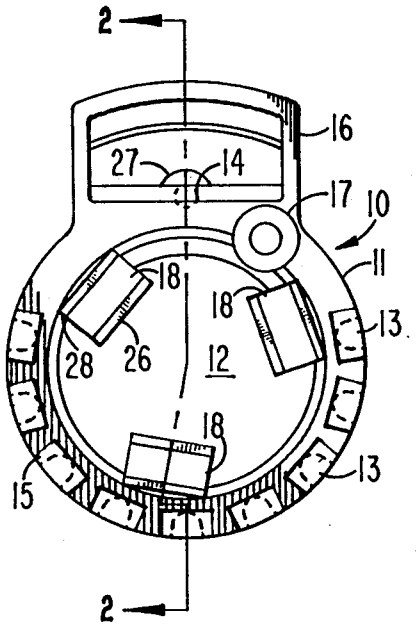
FIG. 1 is a view of one end of a preferred embodiment.

In FIGS. 1 and 2, a base 10 for a CRT includes a cylindrical portion 11 having a substantially centered bore 12. A plurality of pinslots 13 is arranged about the periphery of the cylindrical portion 11 and substantially parallel to the longitudinal axis of the base. A pinhole 14 is spaced further from the other pinslots 13 than the pinslots 13 are from each other. This pinhole receives the connector pin to which the highest electron gun operation voltage is applied and thus this pin requires additional electrical isolation from the other pins. A plurality of rectangular recesses 15 extends parallel to the longitudinal axis of the base 10, and in alignment with the pinslots 13. A silo 16 is integral with the cylindrical portion 11 and surrounds the pinhole 14 to further ensure the electrical isolation of the pin received by the pinhole 14 from the other pins. A fill hole 17 is beveled and is used to inject an insulative material into a portion of the bore 12 after the base 10 is permanently applied to the neck of a tube. A plurality of resilient detents 18 is symmetrically arranged within the bore 12. The detents 18, preferably, are integral with the base 10.

In FIG. 2, a neck portion 19 of a CRT is coaxial with the terminus of an exhaust tubulation 21. An annular stem 22 connects the neck portion 19 and the exhaust tubulation 21. A drip 20 extends beyond the end wall 22, and is the natural result of sealing the stem 22 to the neck 19. A plurality of electrical connector pins 23 and 24 pass through the stem 22 and extend substantially parallel to the longitudinal axis of the neck portion 19. A pin 23 extends into a pinslot 13 and the pin and pinslot are dimensioned so that the pinslot freely receives the pin. All pins are freely received by the pinslots 13. The resilient detent 18 is substantially U-shaped and when in the relaxed, unbiased position shown in FIGS. 1 and 3, the distance between a flexible leaf portion 26 and a fixed portion 28 exceeds the distance between the pin 23 and the side of the tubulation 21. The diameter of the bore 12 exceeds the diameter of the tubulation 21. Accordingly, the base 11 freely slides onto the neck 19 and the leaf portion 26 is biased outwardly by the tubulation 21 to assert a biasing force to the tubulation 21 to temporarily retain the base 11 on the neck 19. In FIG. 2, the pinslots 13 have an angular inside surface 25, which extends inwardly toward the center of the bore 12. The surface 25 causes only the distal ends of the pins 23 to contact the base 10. Accordingly, stresses in bent, or misaligned, pins are reduced. Additionally, the angular surface 25 biases bent, or misaligned, pins outwardly, making it easier to put a base on such pins.

A pin 24 is received by the pinhole 14 in the silo 16. The pin 24 and pinhole 14 also are dimensioned such that the pinhole freely receives the pin. The inside surface of the silo 16, and the rectangular recesses 15 include ramp portions 31, which are in longitudinal alignment with the pins 23 and 24. Electrical leaf contacts within a socket (not shown), which mates with the base 11, are biased by the ramp portions 31 to cause the leaf contacts to slide onto the side surfaces of the pins 23 and 24 without interference from the ends of the pins.

Figure 3:
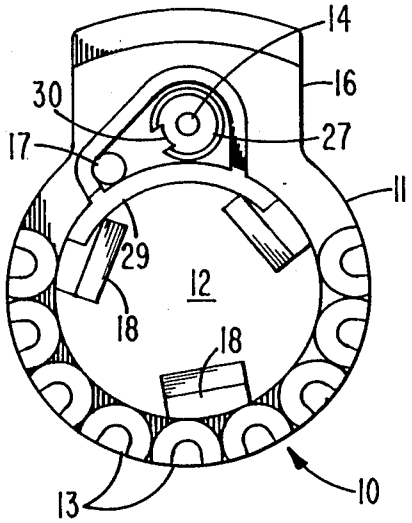
FIG. 3 is a view of the other end of a preferred embodiment.

In FIGS. 2 and 3, the pinhole 14 is included in a circular beveled portion 27 extending inwardly of the base 11. The beveled portion 27 provides a lead-in for slightly bent or misaligned pins. The force required to remove the base 11 from the neck portion 19 is greater than the force required to apply the base because of the inward extension of the circular beveled portion 27. The beveled portion 27 includes a cutout 30, which also assists slightly bent or misaligned pins in passing through the pinhole 14. An arcuate dam 29 is integral with the base 11 and is used to retain an insulative material, which is injected into the space between the tubulation 21 and bore 12, through the fill hole 17, within the space.

Substantial advantages are obtained with the inventive base. The pins are freely received by the pinslots thereby substantially reducing the possibility of bending the pins when the base is mated with neck 19. The resilient detents 18 put a biasing force against the exhaust tubulation 21, to temporarily retain the base 11 on the neck 19. The pins 23 contact the base 10 at the extreme ends of the pins. For this reason, pins which are slightly bent inwardly toward the tubulation 21 can be biased outwardly with a minimum of stress on the fillet where the pins pass through the stem 22. Additionally, because of the circular beveled portion 27, a higher force is needed to remove the base 11 from the neck 19 than is required to apply the base. This feature also assists in retaining the base 11 on the neck portion 19. The ramps 31 cause the resilient electrical contacts of the socket, which is mated with the base 11, to slide into engagement with the sides of the pins 23 and 24 without interference from the ends of the pins 23 and 24, thereby avoiding the possible bending of the pins. The pinslots 13 freely receive the pins 23 and, therefore, the pinslots 13 can be in the extreme periphery of the base 11. This feature allows the outside diameter of the base 11 to be substantially reduced and the base contacts the stem 22 inside the drip 20 and the base, therefore, does not interfere with the unavoidable circumferential drip 20 of the neck portion 19. Additionally, the bore 12 easily slides over the tubulation 21 irrespective of the length of the tubulation. Accordingly, the base 11 can be applied to the pins very early in the processing to protect the pins from being bent during the many subsequent processing steps. Also, because of the loose fit between the bore 12 and tubulation 21, bent, or misaligned, pins can cause the base to shift with respect to the tubulation and the pinslots 13 can receive the pins 23 with a minimum of bending stress on the pins. When the tube reaches the processing stage where the gases are exhausted and the tubulation 21 is cut off and sealed, the base 11 must be removed until the tubulation 21 is sealed. The base 11 can then be reapplied to the neck 19 until further processing and testing indicate that the base should be permanently affixed to the neck, at which time the dielectric material is injected into the fill hole 17.

What is claimed is:

1. A base for a vacuum tube having plurality of electrical connector pins arranged in a circle about and extending through a stem which closes the end of a neck portion, said stem having an exhaust tubulation within said pin circle, said base comprising:

a cylindrical portion having a substantially centered bore, said bore having a diameter greater than the diameter of said exhaust tubulation;

a plurality of resilient detents affixed to said cylindrical portion, and extending into said bore, said detents being dimensioned to engage said tubulation to apply a biasing force to said tubulation and to temporarily hold said base on said neck portion;

a plurality of pinslots arranged about the outside periphery of said cylindrical portion and spaced to individually receive said connector pins, said pinslots and said pins being dimensioned whereby said pinslots freely receive said pins, said pinslots having an angular inside surface extending toward said bore; and a plurality of substantially rectangular recesses longitudinally aligned with said pinslots.

2. The base of claim 1 wherein said rectangular recesses include a ramp portion.

3. The base of claim 1 further including a silo portion integral with said cylindrical portion and arranged about a pinhole to electrically isolate said pinhole from said pinslots, and a ramp portion on the inside surface of said silo portion, said ramp portion being aligned with said pinhole.

4. The base of claim 3 further including a circular beveled portion extending into said base and about said pinhole.

5. The base of claim 4 further including a fill hole for injecting an insulative material into said bore.

6. The base of claim 5 further including an arcuate dam portion within said bore for retaining said insulative material in said bore.

* * * * *